United States Patent [19]

Roetzler

[11] 4,428,409

[45] Jan. 31, 1984

[54] LOG SPLITTER WITH A TAPERED WOOD PENETRATING MEMBER ON THE RAMHEAD

[76] Inventor: Francis J. Roetzler, Box 121, Rte. 1, Buffalo, Minn. 55313

[21] Appl. No.: 267,798

[22] Filed: May 28, 1981

[51] Int. Cl.[3] ..... B27L 7/00

[52] U.S. Cl. ..... 144/193 A; 144/193 E

[58] Field of Search ..... 144/193 R, 193 A, 193 E, 144/366

[56] References Cited

U.S. PATENT DOCUMENTS

| | | | |
|---|---|---|---|
| 85,099 | 12/1868 | Jackson | 144/193 |
| 1,189,999 | 7/1916 | Peter . | |
| 4,102,373 | 7/1978 | Winiasz | 144/193 |
| 4,141,396 | 2/1979 | McCallister | 144/193 |
| 4,192,364 | 3/1980 | Findley | 144/193 |
| 4,275,778 | 6/1981 | Kotas | 144/193 E |

FOREIGN PATENT DOCUMENTS

| | | | |
|---|---|---|---|
| 2902783 | 8/1979 | Fed. Rep. of Germany | 144/193 A |

*Primary Examiner*—W. D. Bray

*Attorney, Agent, or Firm*—Kinney, Lange, Braddock, Westman and Fairbairn

[57] ABSTRACT

A truncated generally conical or tapered member is mounted on a movable ramhead of a hydraulically operated log splitter. A wood splitting wedge is mounted on the frame of the log splitter opposite the tapered member of the ramhead such that a block of wood may be placed between the ramhead and wedge. The narrow end of the truncated conical member is a size to engage and center the log and retain the log from lateral and vertical movement as the log is split. The tapered member has a taper selected to insure that the end of the member will penetrate the wood at a controlled rate as the splitting force of the ramhead increases. The time element, established by the controlled penetration rate, is of primary importance. Should an operator inadvertently have a portion of his hand, between the log's end and ram face, the time element allows for removal of the operator's hand before it would be crushed between the log and ram face. In addition, the taper is such that the truncated generally conical member is easily disengaged from the block of wood being split when the ramhead is retracted.

4 Claims, 6 Drawing Figures

LOG SPLITTER WITH A TAPERED WOOD PENETRATING MEMBER ON THE RAMHEAD

BACKGROUND OF THE INVENTION

1. Field of the Invention

The present invention relates to log splitters, and in particular, to log splitters with hydraulically actuated ramheads.

2. Description of the Prior Art

Log splitters that split logs by forcing a wedge into a log through the use of a hydraulically driven member are generally well known. The prior art log splitters for the most part split logs in a satisfactory manner. However, the prior art log splitters are often dangerous, especially to the unskilled persons attempting to use them. Typically, a log is held manually on the log splitter until a hydraulically actuated ramhead engages an end of the log forcing the log into the splitting wedge. The operator generally holds onto the end of the log which is engaged by the hydraulically actuated ramhead. There is a great danger that a portion of his fingers or hands may be caught in the initial contact between the ramhead and the log. This is so even with log splitters having a wedge mounted on the hydraulically actuated ramhead. Moreover, if the log has a knot, abnormal growth, or has been cut at an angle not perpendicular to the log's axis, the log may be ejected laterally or vertically from the log splitter during the splitting operation.

Typical examples of prior art log splitters are found in several prior art patents. The Jackson U.S. Pat. No. 85,009 shows a log splitter with a four-bladed splitting knife for splitting horizontally positioned logs mounted on a frame. Two wedge-shaped cutting knives facing each other for cutting the logs to be split are also included on the same frame.

The Peter U.S. Pat. No. 1,189,999 shows a multiple prong holder that includes a plurality of cutting blades spaced about the circumference of a central member for engaging the ends of a log. The log is pushed by means of a worm and worm-wheel mechanism, pushing the log into the cutting blades thereby splitting the wood.

The Winiasz U.S. Pat. No. 4,102,373 describes a log splitter having an inflatable bladder that pushes a log upwardly against a plurality of shearing blades. A stabilizing "clete" is provided to help retain the log in position during the shearing operation.

The McCallister U.S. Pat. No. 4,141,396 illustrates a hydraulically actuated log splitter having a stationary splitting wedge against which a log is pushed by a hydraulically driven push plate. A generally vertical bar is welded to the push plate and engages the log during the splitting operation.

The Findley U.S. Pat. No. 4,192,364 shows a log splitter having a stationary splitting wedge attached to a frame and a hydraulically driven splitting wedge that drives a log into the stationary splitting wedge, splitting the log.

SUMMARY OF THE INVENTION

The present invention includes a log splitter with a splitting wedge attached to a frame and a ramhead for providing a splitting force to a piece of wood. The improvement includes a generally conical or tapered member having a base and a narrow penetrating end for initially engaging and penetrating the piece of wood. The base of the tapered or conical member is secured to the ramhead. The angle of taper of the tapered member is selected to insure that it will penetrate the piece of wood at a controlled rate as the piece of wood is forced against the wood splitting wedge.

The small size end and the taper angle of the generally tapered member, along with the resulting controlled rate of penetration, minimizes the danger to the operator of having any portions of his fingers or hands being caught between the end of the piece of wood and the moving ramhead while holding the piece. In addition, the penetrating end tends to act as a centering member and retain the piece of wood in splitting position. This tends to prevent the wood from flying laterally or vertically out of the log splitter during the splitting operation.

DETAILED DESCRIPTION OF THE PREFERRED EMBODIMENT

Figure 1:
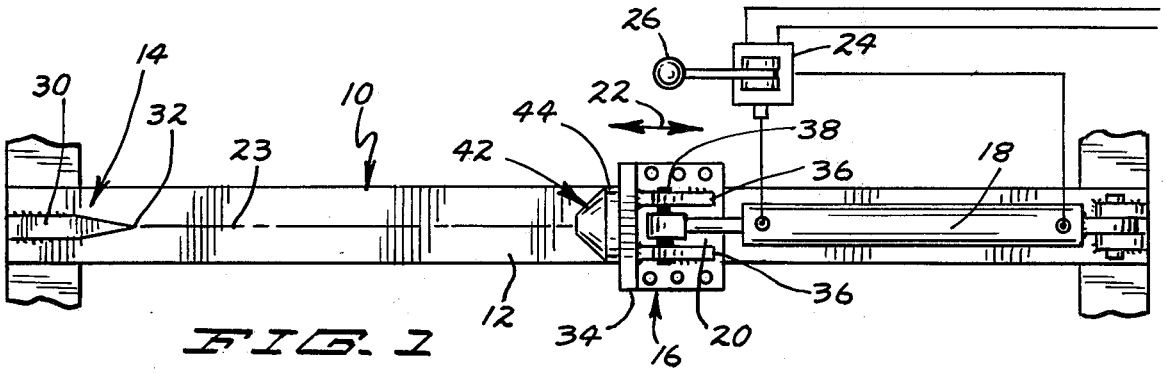
FIG. 1 is a top view of a log splitter of the present invention.
Figure 2:
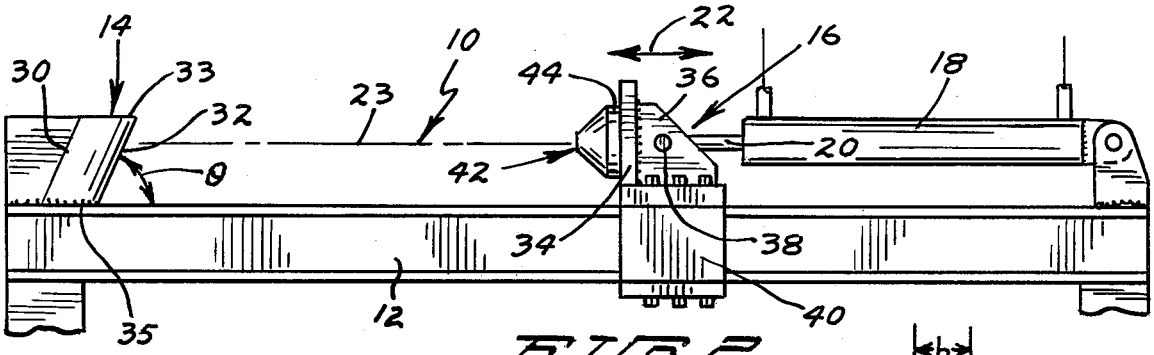
FIG. 2 is a side elevational view of the log splitter of the present invention.

A log splitter of the present invention is generally indicated at 10 in FIGS. 1 and 2. Like reference characters are used to indicate like elements throughout the figures. The log splitter includes a generally horizontal frame 12 and a splitting wedge 14, preferably stationary, attached to the frame 12. A ramhead 16, or equivalent structure, is movable along the frame 12 providing a splitting force and is preferably driven in a horizontal direction by a hydraulic cylinder 18. The ramhead 16 is attached to the piston rod 20 of the hydraulic cylinder 18. The cylinder 18 is actuated by a valve 24 having a control lever 26 and which controls fluid under pressure from a pump. The hydraulic cylinder 18 is double acting and the piston rod is movable in opposite axial directions indicated by arrow 22.

The splitting wedge 14 is preferably a wedge-shaped blade having a base 30 tapering to a cutting edge 32. Preferably, the cutting edge 32 of the wood splitting member forms an undercut edge from its top surface 33 to its bottom 35 such as shown in FIG. 2. In one working embodiment, the angle of undercut indicated by , is approximately ten degrees. In addition, the top surface 33 of the splitting wedge is above the splitting axis 23 which is the axis of cylinder 18.

The ramhead 16 preferably includes a substantially vertical pusher plate 34 supported on a gib bed or boxed carrier 40 by a pair of gussets 36 that are parallel to the direction of the splitting force. The piston rod 20 is connected to the ramhead in a suitable manner such as being pivotally attached to a connecting pin 38 that passes through the gussets 36. The ramhead 16 also includes a carrier 40, as indicated in FIG. 2, that rides along the frame 12 to guide the ramhead 16 as it moves along the splitting axis. It will be apparent to those skilled in the art that the ramhead and carrier may be varied in detail without departing from the scope of the present invention.

Figure 3:
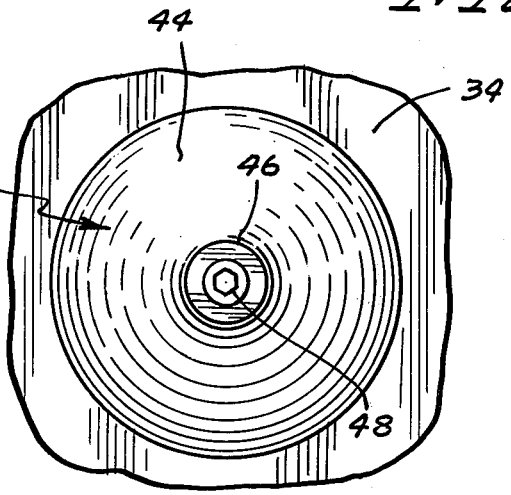
FIG. 3 is an end view of the tapered, or conical, wood penetrating member on the ramhead.
Figure 4:
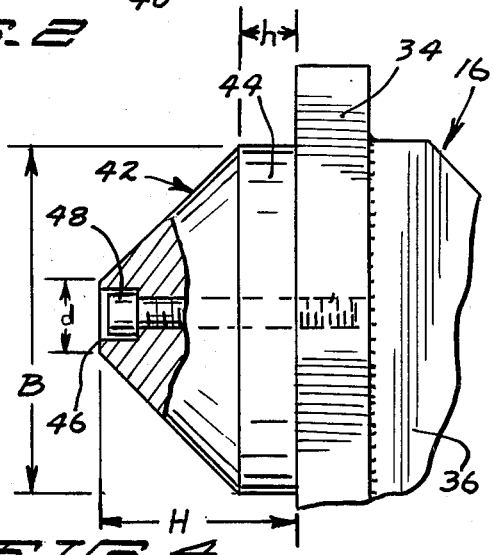
FIG. 4 is a side elevational view of the tapered member of FIG. 3 with portions broken away to illustrate the construction.

A tapered wood or log penetrating member 42 (called a generally conical member) is attached to the pusher plate 34 centered on the axis 23 of the hydraulic cylinder 18. Referring to FIGS. 3 and 4, the tapered member shown is a truncated right cylindrical cone and has a base end 44 and tapers to a smaller penetrating end 46. The member 42 is preferably of a solid construction, although a hollow member with a solid surface or a welded plate construction (as will be shown) is also contemplated. The material used to construct the penetrating member must have a strength greater than that of wood. Metal such as steel, cast iron or aluminum is preferred. The member 42 is attached to the pusher plate 34 by a fastener 48 such as a socket head cap screw threadably engaging a threaded aperture in the pusher plate 34.

Through experimentation, it has been found that the height, indicated by H, of the tapered wood penetrating member 42 is approximately 40% to 60% of the diameter of the base, indicated by B. The height "h" of the base end 44 has to be sufficient for construction purposes and is about 14% of the diameter B. The diameter of the penetrating end 46, indicated by d, is substantially between 15% and 35% of the diameter of the base. The included angle of the taper of the tapered member is approximately between 80° and 100°. The included angle is the angle formed by the outer suface of revolution of the member 42. Correspondingly, if the included angle is approximately ninety degrees, the angle formed by the exterior surface of the member 42 with its central axis is approximately forty five degrees.

Figure 5:
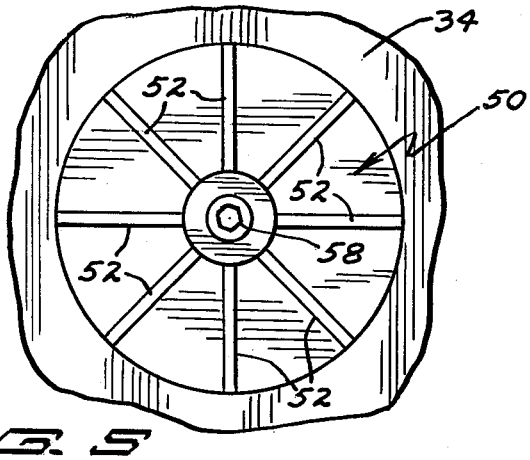
FIG. 5 is an end elevational view of an alternative embodiment of the tapered or conical wood penetrating member of the present invention.
Figure 6:
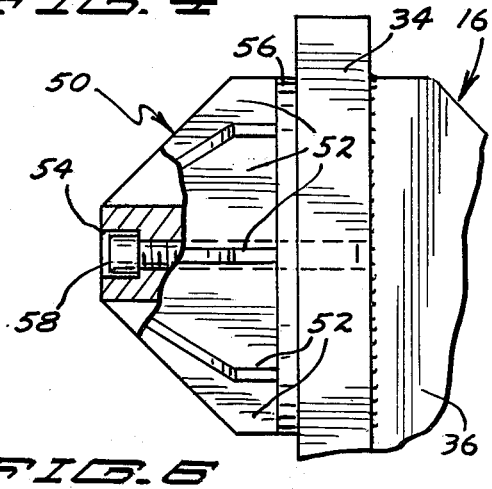
FIG. 6 is a side elevational view of the embodiment of FIG. 5 with parts broken away.

In an alternative embodiment, indicated at 50 in FIGS. 5 and 6, the tapered wood penetrating member is formed from a plurality of radially extending triangular plates 52 which are fixed to a core shaft adjacent a central axis and the outer (hypotenuse) edges of which conform to the taper of a truncated cone. The plates are symmetrical about the central axis. This type of tapered member is also called a generally conical member even though it does not have a surface of revolution formed about its axis.

The tapered wood penetrating member 50 tapers from a penetrating end 54 to a base plate 56 on which other edges of plates are fixed. The base 56 abuts the pusher plate 34 of the ramhead 16. The member 50 is attached to the pusher plate 34 by an socket head screw 58, as shown.

The number of radially extending plates 52 is selected so they are symmetrical and that the penetration of the member 50 into a piece of wood is controlled for safety purposes. At least four such plates are generally desired.

In use, a log is moved into place on the log splitter and is supported on the frame and against the splitting wedge in a conventional manner. The hydraulic system is actuated and the ramhead moves the tapered wood penetrating member toward the wood or log in place on the frame. The tapered (generally conical) wood penetrating member penetrates the wood at a controlled rate. Initially, the tapered member penetrates the piece of wood to be split comparatively quickly. As the tapered member further penetrates into the wood, the rate of penetration decreases due to the conical or tapered surface even though the force of the ramhead is increasing during the splitting operation. The comparatively quick initial penetration serves to hold the piece of wood (or log) in place, preventing the wood from being laterally or vertically ejected during splitting. The three points of contact on the log, the wedge, the frame, and the tapered member insure the log is held in place. The further slower penetration of the piece of wood by the tapered member provides sufficient time for an operator to remove his hands from the end of the log or to retract the cylinder before the end of the log reaches the pusher plate 34 where the fingers were formerly many times crushed. The penetrating end of the tapered member provides a reduced area of initial wood contact, minimizing the danger of fingers or hands being caught and crushed during the initial contact between the wood and the tapered member on the ramhead.

The tapered member also reduces excessive lateral and vertical forces during the splitting operation by positively engaging the piece of wood with the penetrating end. The positive engagement increases the efficiency of the log splitter with regard to the power required to split wood. In addition, when the axis of the tapered member is coaxial with the cylinder 18, lateral and vertical strain and wear on the hydraulic cylinder parts is reduced. Bending forces are also reduced by the positive alignment of the tapered penetrating member axis with the axis of the force applied by the cylinder.

The penetrating end of the tapered (truncated conical) member can also be brought to within close proximity of the splitting wedge's cutting edge providing a more complete thrust of the wood being split by the splitting wedge.

It should be noted that the tapered wood penetrating member is symmetrical about its axis so there are greatly reduced side forces as the ramhead and tapered penetrating member engage the log.

CONCLUSION

The present invention provides a log splitter that is safe to operate, minimizing danger of injury to the operator. The block of wood being split is held securely in place when once contacted by the tapered wood penetrating member. Furthermore, the danger of injury to an operator's fingers or hands is greatly reduced since the initial contact by the member is at the penetrating end which has a relatively small area and the fingers will tend to slide off the end rather than be crushed.

Although the present invention has been described with reference to the preferred embodiment, workers skilled in the art will recognize that changes can be made in form and detail without departing from the spirit and scope of the invention.

What is claimed is:

1. In a wood splitter having a frame, a wood splitting member fixed relative to the frame, and a movable ramhead adapted to move wood to be split against the wood splitting member at a controlled rate, the improvement comprising:

a pusher plate forming a portion of the ramhead;

a generally conical member on said pusher plate facing toward the splitting member and having outer surface portions tapering from a generally narrow penetrating end facing the splitting member to a base of smaller size than the pusher plate mounted on said pusher plate, the tapered outer surface portion insuring that the penetrating end of the member will engage an end surface of a piece of wood as the wood also engages the splitting member;

a hydraulic motor for moving the pusher plate in the direction of the splitting member;

a control valve having a manually postitionable control for controlling the flow of hydraulic fluid from a source under pressure to the hydraulic motor, the outer surface portion of the generally conical member having the surface of a right cylindrical cone with a base and a height and truncated at the penetrating end, the penetrating end having a diameter substantially between 15% and 35% of the diameter of the base, the height of the generally conical member from the base to the penetrating end being in the approximate range of 40% to 60% of the base, and said generally conical surface having an angle of taper which is approximately between 80° and 100° so that the conical member will penetrate the wood at a controlled rate as the force input on the ramhead increases under the control of the manually positionable control, thereby establishing a minimum time element before the end surface of a piece of wood being split bottoms on the ram pusher plate as the maximum splitting effect is accomplished.

2. The apparatus of claim 1 wherein the wood splitting member comprises a substantially upright member having an upper end and a lower end and a cutting edge facing the ramhead, the cutting edge being undercut such that the upper end of the cutting edge is closer to the ramhead than the lower end.

3. The apparatus of claim 1 wherein the hydraulic motor is a hydraulic cylinder which actuates the ramhead, the stroke of the cylinder being selected such that the penetrating end of the cone does not contact the splitting member when the cylinder is fully extended.

4. The apparatus of claim 1 in which the ramhead is slidably mounted on the frame of the wood splitter to minimize the lateral forces on a piece of wood being split.

* * * * *